US005419589A

United States Patent [19]

Fattore

[11] Patent Number: 5,419,589

[45] Date of Patent: May 30, 1995

[54] APPARATUS AND METHOD FOR CARRYING IMPRINTS OF BODY PORTIONS

[76] Inventor: James A. Fattore, 16260 Prince Dr., South Holland, Ill. 60473

[21] Appl. No.: 942,748

[22] Filed: Sep. 9, 1992

[51] Int. Cl.[6] ..... B42D 15/00; G09F 1/12

[52] U.S. Cl. ..... 283/62; 40/152.1; 40/152; 283/78; 283/69

[58] Field of Search ..... 40/152, 152.1, 152.2; 283/62, 69, 78; 462/1

[56] References Cited

U.S. PATENT DOCUMENTS

| | | | |
|---|---|---|---|
| 261,132 | 7/1882 | Brodhag | 40/152 |
| 713,170 | 11/1902 | Stiff | 40/152.1 |
| 1,270,475 | 6/1918 | Wilkenson | 40/152 |
| 1,483,926 | 2/1924 | Chadwick et al. | 283/78 X |
| 1,676,495 | 7/1928 | Hammond | 283/69 X |
| 2,303,328 | 12/1942 | Cross | 40/152.1 |
| 2,317,204 | 4/1943 | Lowenthal | 40/152.1 |
| 2,875,542 | 3/1959 | Peach | 40/152.1 |
| 3,237,333 | 3/1966 | Bacharach | 40/152 |
| 4,777,746 | 10/1988 | Brooks | 40/152.1 |

*Primary Examiner*—Paul A. Bell
*Attorney, Agent, or Firm*—Potthast & Ring

[57] ABSTRACT

An apparatus (10) for carrying imprints of body parts (12) having at least one opening (16) and having a surface area of dye absorbent planar surface (18) in which the surface area (18) is greater than the surface area in the at least one opening (16) of the sheet member (14) and in which the surface area (18) is smooth and continuous to receive impressions of body portions (12) carrying dye (32), allowing a picture (20) to be mounted to the sheet member (14) visible through said at least one opening (16) in a position visible in the same direction as the absorbent planar surface (18), and providing alignment structure of the impressions (12) and spacing of the impressions (12) from the edge (46) of the sheet member (14) in which the alignment structure overlies at least a portion of the sheet member (14). This invention further includes a method for positioning a picture (20) onto a sheet member (14) in which at least a portion of the picture (20) is visible, applying a dye substance (32) to at least one portion of the body and impressing the at least one body portion carrying the dye substance (32) onto the sheet member (14). This invention further includes a display kit (34) for mounting a picture (20) and impressions of body portions (12) including a sheet member (14) having at least one opening (16) and having at least a portion of the surface area (18) of the sheet member (14) dye absorbent, a non-toxic dye substance (32), and mounting the picture (20) to the sheet member (14) in a position visible through said one opening (16) and in a position visible in the same direction as the dye absorbent surface (18).

17 Claims, 6 Drawing Sheets

APPARATUS AND METHOD FOR CARRYING IMPRINTS OF BODY PORTIONS

BACKGROUND OF THE INVENTION

1. Field of the Invention

The present invention relates to an apparatus for carrying a picture and imprints of body portions. More particularly, this invention provides a sheet member having at least one opening for viewing the picture and having a surface area of dye absorbent planar surface for receiving impressions of body portions carrying dye and a structure for aligning the same, including but not limited to hands, bottoms of feet, buttocks, as well as a method and display kit assembly to employ the same.

2. Description of the related art including information disclosed under 37 CFR 1.97–1.99

Various apparatus are known which display imprints of body portions on dye absorbent material. For example, when a person is born, hospitals take imprints of the bottom of his foot, using a dye substance and imprint the bottom of the foot onto the dye absorbent material of his birth certificate. This imprint of the bottom of a person's foot is for identification purposes. Additionally, when a person is arrested, police officers take imprints of his finger tips using a dye substance also for identification purposes. Another apparatus is known which displayed imprints of body portions with non-toxic dyes on a continuous sheet member of dye absorbent material which had a means for securing a picture to the sheet member. However, none of the above described apparatuses provide an opening in the dye absorbent material for mounting a picture of the person whose body portions are being imprinted on the dye absorbent material.

Additionally, various apparatuses are known having at least one opening and having a dye absorbent planar surface area. For example, picture frames have at least one opening and have a dye absorbent backing surface. The dye absorbent surface area is not visible once the picture is placed in the frame opening.

Border mats having at least one opening and having a dye absorbent surface area are known in the art. However, this apparatus does not overlie a dye absorbent surface and provide relative alignment of impressions of body portions and alignment of the impressions to provide spacing of impressions of body portions from the edge of the absorbent sheet member.

Picture mattings having multiple openings for displaying individual photographs are known in the art. However, this apparatus does not overlie a dye absorbent surface and provide relative alignment of impressions of body portions and alignment of the impressions to provide spacing of impressions of body portions from the edge of the absorbent sheet member and this apparatus does not have a dye absorbent surface area in which the surface area is greater than the surface area in the at least one opening of the sheet member and in which the surface area is smooth and continuous. Thus, these apparatuses do not have enough surface area on the sheet member around the opening for the picture to adequately display imprints of body portions of the person displayed in the picture.

SUMMARY OF THE INVENTION

It is therefore the object of this invention to provide an apparatus for carrying imprints of body parts having at least one opening and having a surface area of dye absorbent planar surface in which the surface area is greater than the surface area in the at least one opening of the sheet member and in which the surface area is smooth and continuous to receive impressions of body portions carrying dye, allowing a picture to be mounted to the sheet member visible through said at least one opening in a position visible in the same direction as the absorbent planar surface, and providing alignment structure of the impressions and spacing of the impressions from the edge of the sheet member in which the alignment structure overlies at least a portion of the sheet member.

It is a further object of this invention to provide a method for positioning a picture onto a sheet member in which at least a portion of the picture is visible, applying a dye substance to at least one portion of the body and impressing the at least one body portion carrying the dye substance onto the sheet member.

It is a further object of this invention to provide a display kit for mounting a picture and impressions of body portions including a sheet member having at least one opening and having at least a portion of the surface area of the sheet member dye absorbent, a non-toxic dye substance, and mounting the picture to the sheet member in a position visible through said one opening and in a position visible in the same direction as the dye absorbent surface.

BRIEF DESCRIPTION OF DRAWING

The foregoing objects and advantageous features of the invention will be explained in greater detail and others will be made apparent from the detailed description of the preferred embodiment of the present invention which is given reference to the several figures of the drawing, in which.

DETAILED DESCRIPTION

Figure 1:
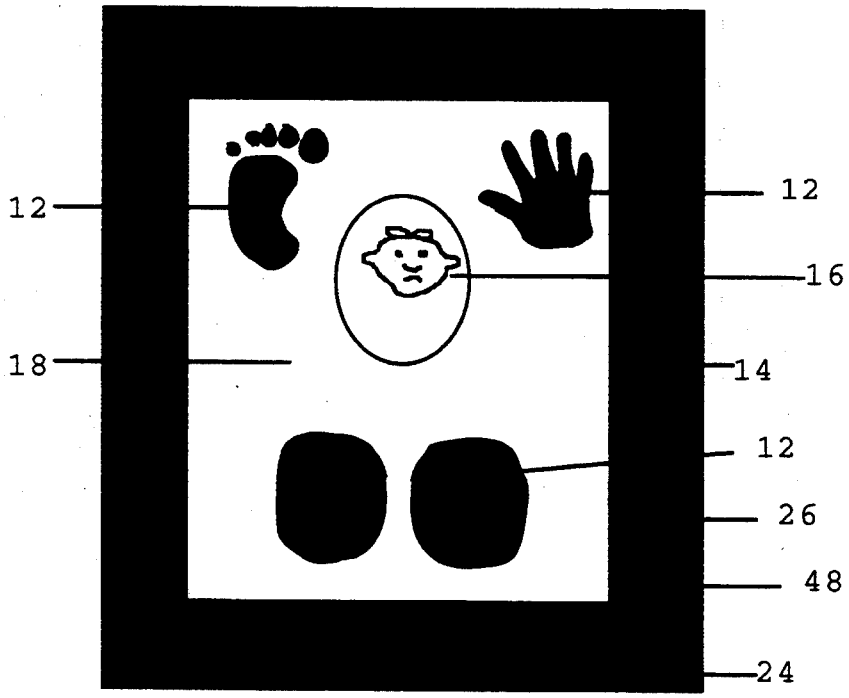
FIG. 1 is a top plan view of the apparatus.

Referring now to the drawings, apparatus 10 for carrying imprints of body portions 12 can be seen in FIG. 1. As seen in FIG. 1, a typical structure may find sheet member 14 having at least one opening 16 in which at least a portion of picture 20 is visible. Opening 16 is oval shaped or any other workable shape known in the art. Sheet member 14 is composed of a vellum bristol board or any other suitable substance known in the art.

Sheet member 14 having at least one opening 16 includes surface area of dye absorbent planar surface 18 in which surface area of dye absorbent planar surface 18 is greater than the surface area in at least one opening 16 to sheet member 14. Surface area 18 is smooth, continuous and dye absorbent to receive impressions of body portions 12 carrying dye.

Apparatus 10 also includes means for mounting picture 20 to sheet member 14 visible through said at least one opening 16 in a position visible in the same direction as the absorbent planar surface 18. The means for mounting picture 20 to sheet member 14 includes tape or any other suitable adhesive means known in the art.

Figure 3:
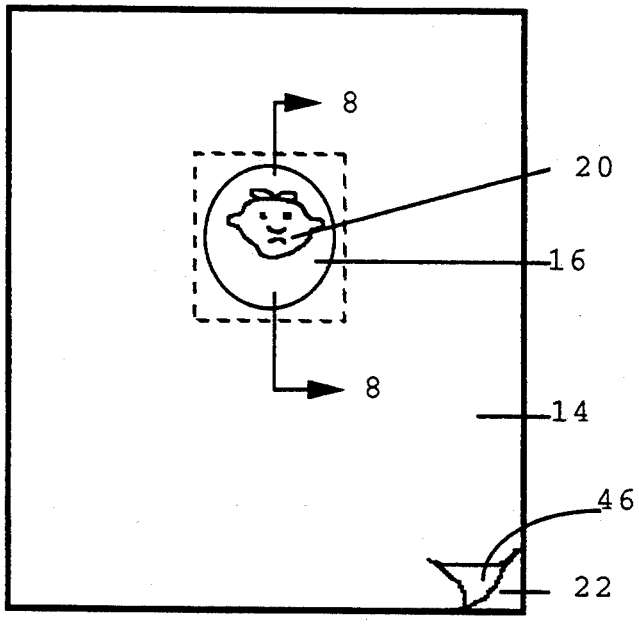
FIG. 3 is a top plan view of sheet member overlying another sheet member.
Figure 8:
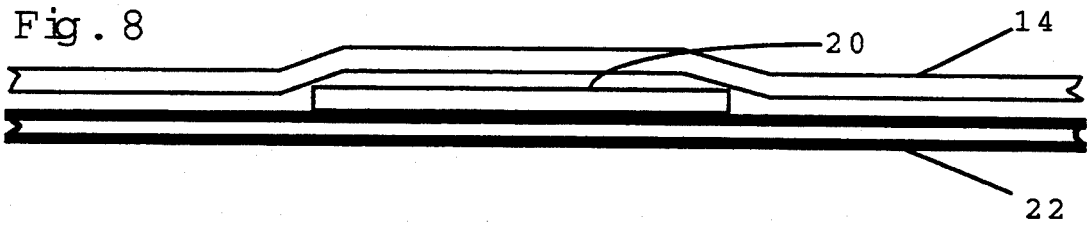
FIG. 8 is a partial cross sectional view of FIG. 3 along line 8—8.
Figure 7:
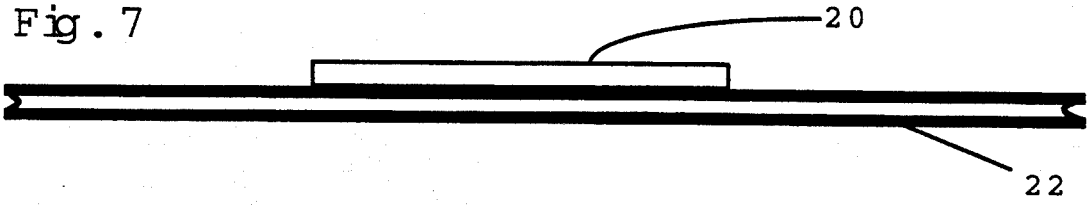
FIG. 7 is a partial cross sectional view of FIG. 2 along line 7—7.
Figure 12:
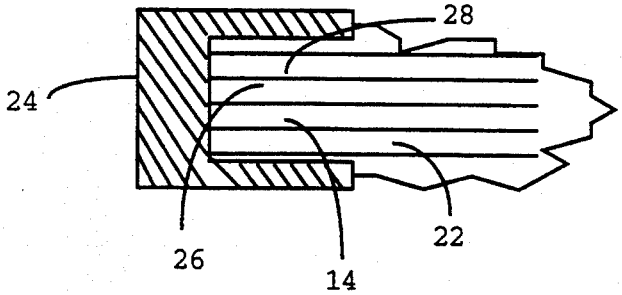
FIG. 12 is a partial cross sectional view of FIG. 12 along line 12—12 including members to be secured by the frame shown in phantom.

Referring now to FIGS. 3 and 8, means for mounting picture 20 to sheet member 14 also includes overlying sheet member 14 over another sheet member 22 to secure picture 20 therebetween in which sheet member 14 overlies another sheet member 22. Another sheet member 22 adds support to sheet member 14, thereby further protecting picture 20. Frame 24 holds sheet member 14 (in phantom) and another sheet member 22 (in phantom) in overlying relationship whereby sheet member 14 tightly presses against another sheet member 22, thereby securing picture 20, as seen in FIG. 12.

Apparatus 10 also includes means to provide relative alignment 40 of impressions 12 and alignment of impressions 12 to provide spacing of impressions 12 from edge 46 of the sheet member 14 in which alignment means 48 overlies at least a portion of sheet member 14. Alignment means 48 on impressions 12 includes border member 26 overlying at least a portion of sheet member 14. Border member 26 provides spacing from edge 46 of sheet member 14, thereby providing a guide for maintaining impressions 12 spaced from edge 46. Further, the straight edges of border member 26 provide a guide when aligning the body portions in relative alignment with each other at the time of making impressions 12. Border member 26 is made of cardboard or any suitable material known in the art.

Figure 5:
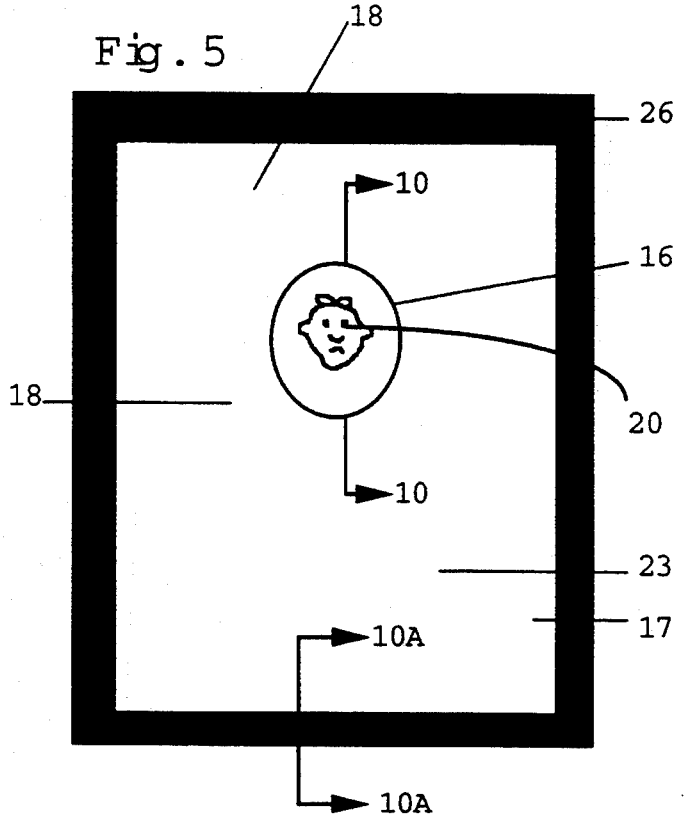
FIG. 5 is a top plan view of FIG. 4 of light transmittable panel overlying the border member.
Figure 10A:
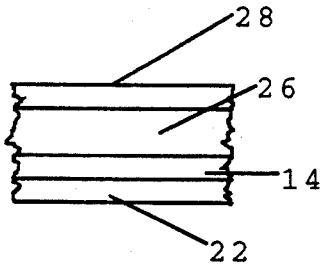
FIG. 10A is a partial cross sectional view of FIG. 6 along line 10A—10A.
Figure 10:
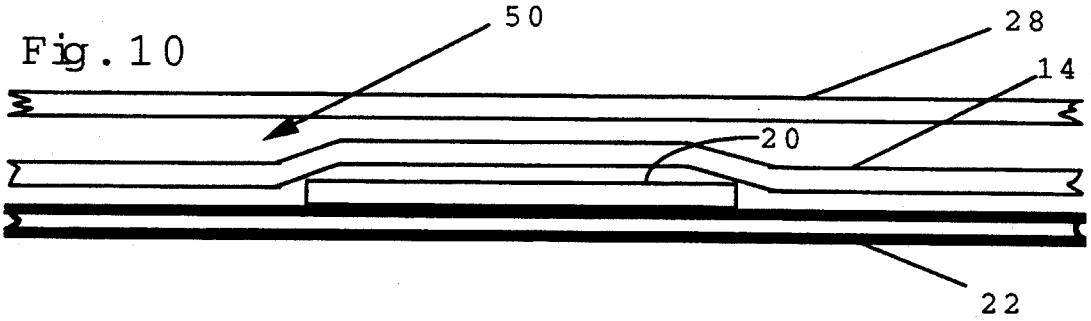
FIG. 10 is a partial cross sectional view of FIG. 5 along line 10—10.

Referring now to FIG. 5, apparatus 10 also includes light transmittable panel 28 overlying sheet member 14 which is composed of plexiglass, glass, plastic and other like suitable material known in the art. Light transmittable panel 28 protects imprints of body portions 12 and picture 20 from being damaged by elements outside light transmittable panel 28 such as water, heat, scratches and the like. Additionally, light transmittable panel 20 overlies sheet member 14, whereby space 50, as seen in FIG. 10, between light transmittable panel 28 and sheet member 14 created by border member 26, as seen in FIG. 10A so light transmittable panel 28 is not in contact with sheet member 14 or picture 20. Thus, light transmittable panel 28 will not damage imprints of body portions 12 on sheet member 14 or picture 20.

Figure 2:
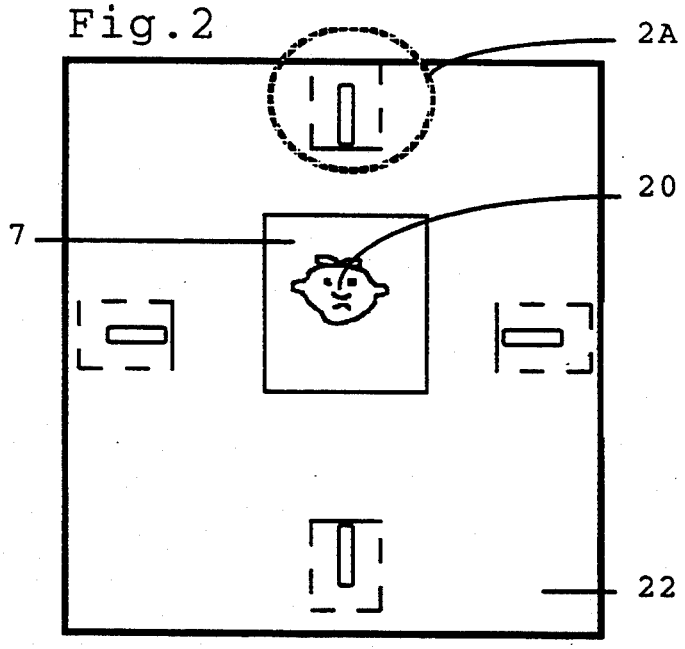
FIG. 2 is a top plan view of another sheet member with a picture disposed thereon.
Figure 2A:
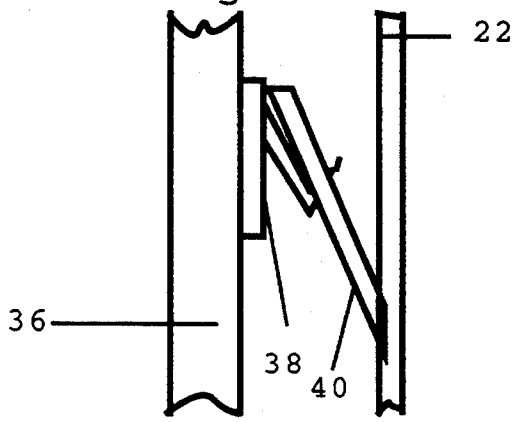
FIG. 2A is a partial side view of hanger member of FIG. 2 designated as 2A deployed and engaged to hook.
Figure 2B:
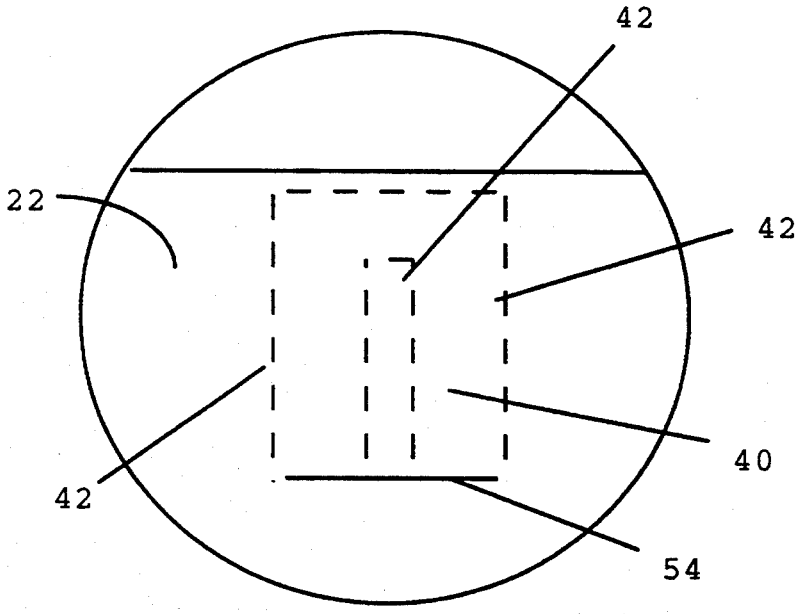
FIG. 2B is a partial plan view of hanger member of FIG. 2 designated as 2A nondeployed.

Referring now to FIGS. 2A and 2B, apparatus 10 also includes means for mounting another sheet member 22 to wall 36 in order that another sheet member 22 can conveniently be displayed to viewers. In order to mount another sheet member 22 to wall 36, another sheet member 22 is mounted to hook member 38 secured to wall 36 whereby hanger member 40 is deployed from another sheet member 22 and engaged to hook member 38 secured to wall 36. Hanger member 40 is deployed from another sheet member 22 by punching out hanger member 40 along serrations 42 of hook member 40 and bending hook member 40 outwardly from another sheet member 22 as seen in FIG. 2A along score line 54 as seen in FIG. 2B.

Referring now to FIGS. 1 and 8, this invention includes a method for carrying imprints of body portions 12 which includes the step of positioning picture 20 onto sheet member 14. The step of positioning picture 20 includes aligning at least a portion of picture 20 to be visible through opening 16 in sheet member 14. Sheet member 14 is composed of a vellum bristol board or any other suitable substance known in the art. Sheet member 14 has at least an opening 16 and opening 16 is oval shaped or any other workable shape known in the art.

The method on the invention further includes the step of securing picture 20 to sheet member 14. The step of securing picture 20 also includes positioning picture 20 between sheet member 14 and another sheet member 22 in which sheet member 14 overlies another sheet member 22, as seen in FIG. 3. Another sheet member 22 adds support to sheet member 14, thereby further protecting picture 20. Another sheet member is composed of cardboard or other suitable material known in the art.

Referring now to FIG. 12, the step of securing picture 20 further includes securing sheet member 14 (in phantom) and another sheet member 22 (in phantom) together with frame 24. Frame 24 is also able to secure sheet member 14 (in phantom), another sheet member 22 (in phantom), border member 26 (in phantom) and light transmittable panel 28 (in phantom), as seen in FIG. 12.

Figure 4:
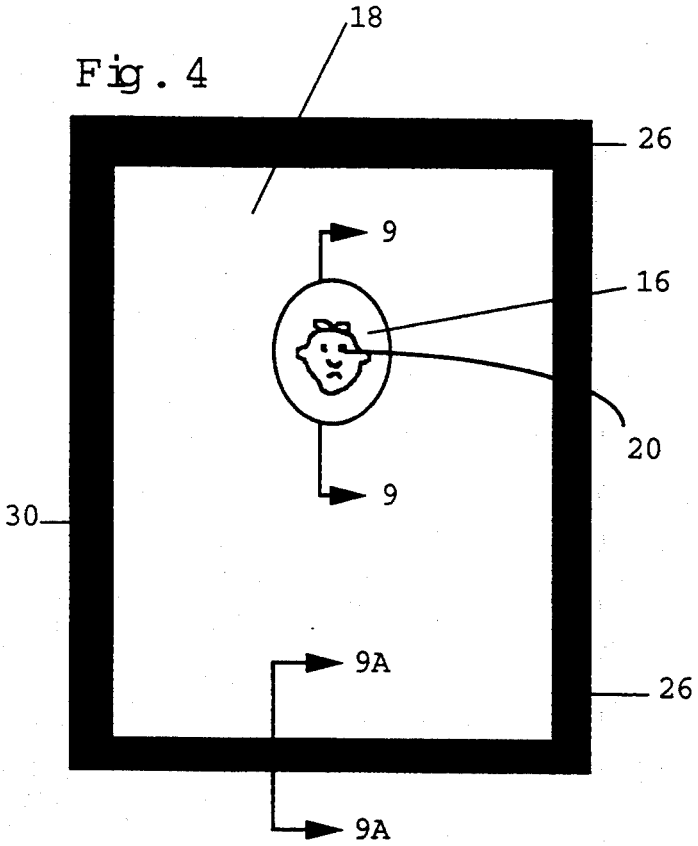
FIG. 4 is a top plan view of FIG. 3 of border member overlying sheet member.
Figure 9A:
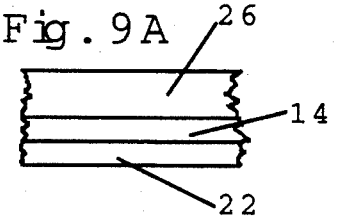
FIG. 9A is a partial cross sectional view of FIG. 4 along line 9A—9A.
Figure 9:
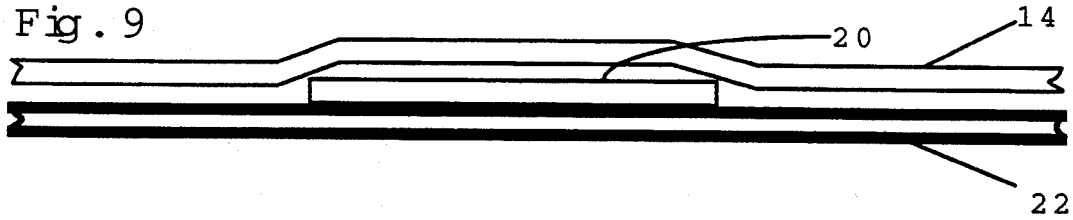
FIG. 9 is a partial cross sectional view of FIG. 4 along line 9—9.

Referring now to FIGS. 4, 9 and 9A, the method for carrying imprints of body portions 12 further includes the step of placing board member 26 to overlie at least a portion of sheet member 14. It further includes the step of tracing overlying edge 30 of board member 26 onto sheet member 14. The step of tracing overlying edge 30 of board member 26 illustrates what area 18 of sheet member 14 will be visible under border member 26 so when imprints of body portions 12 are taken, imprints 12 are impressed only on area 18 of sheet member 14 that is visible underneath border member 26. Thus, border member 26 relatively aligns impressions 12 and aligns impressions 12 to provide spacing of impressions 12 from edge 46 of sheet member 14. Additionally, border member 26 is a protective covering spaced from dye impressions 12 to keep the dye from impression 12 from rubbing against light transmittable panel 28 overlying sheet member 14. Border member 26 is made of cardboard or any suitable material known in the art.

Referring now to FIGS. 5, 10 and 10A, the method for carrying imprints of body portions 12 further includes the step of positioning light transmittable panel 28 to overlie sheet member 14. Light transmittable panel 28 protects imprints of body portions 12 and picture 20 from being damaged by elements outside light transmittable panel 28 such as water, heat, scratches and the like. Additionally, light transmittable panel 20 overlies border member 26, thereby forming space 50 between light transmittable panel 28 and sheet member 14 so that light transmittable panel 28 is not in contact with sheet member 14 or picture 20 so light transmittable panel 28 will not damage imprints of body portions 12 on sheet member 14 or picture 20. Light transmittable panel 28 is made of plastic or glass or any other suitable light transmittable material.

Figure 6:
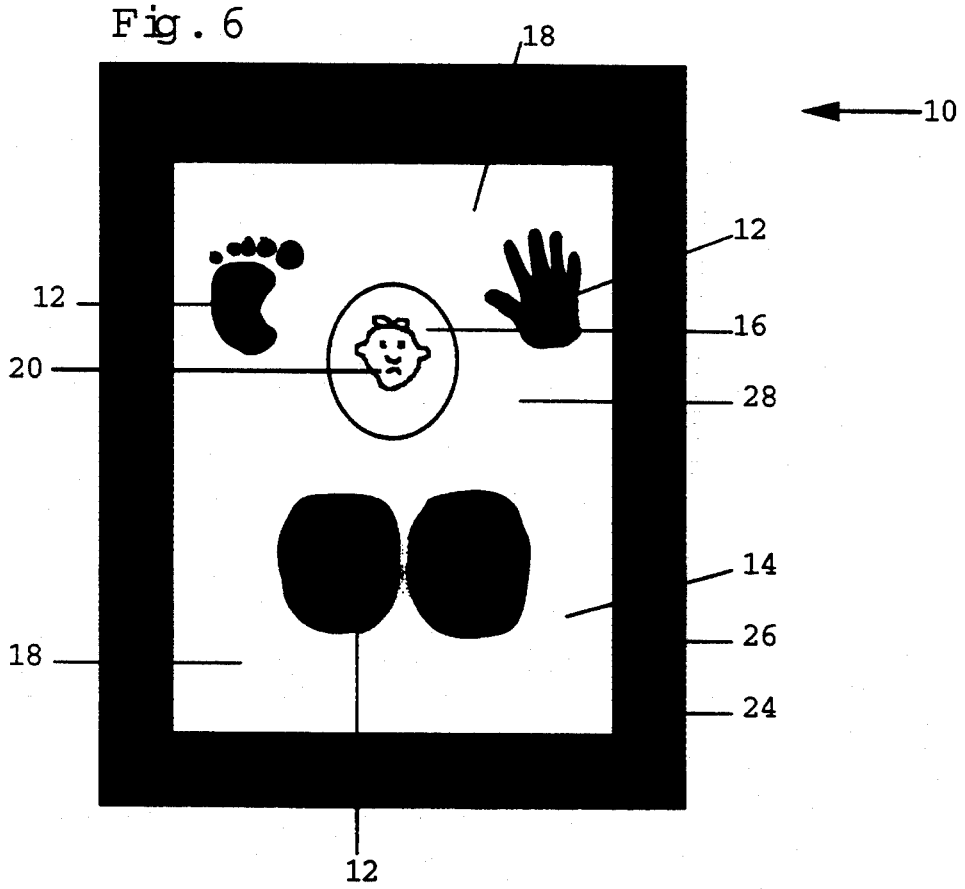
FIG. 6 is a top plan view of FIG. 5 with frame.
Figure 11:
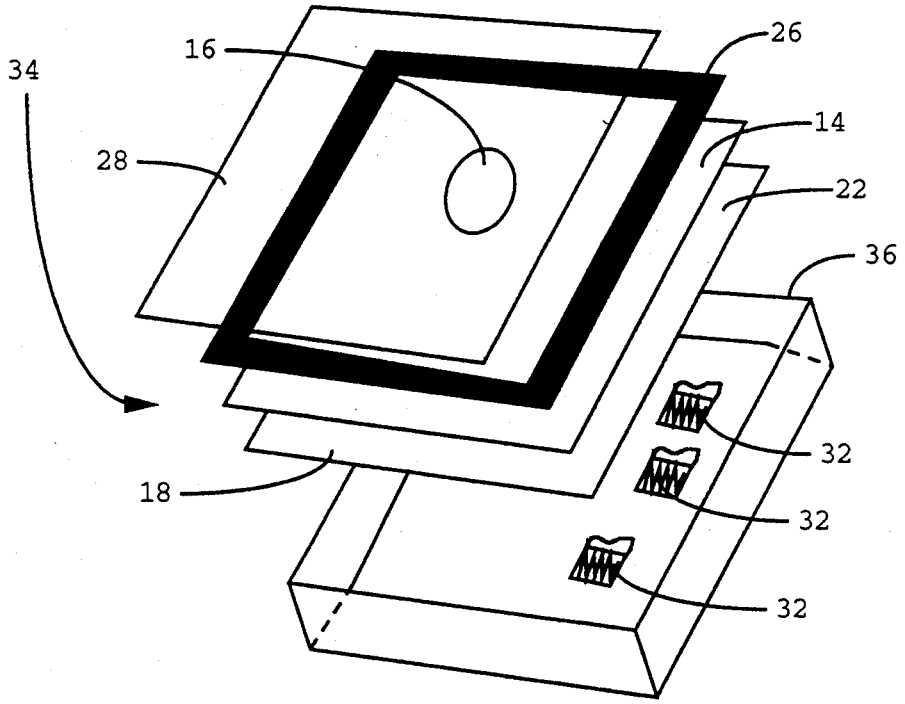
FIG. 11 is an exploded perspective view of the display kit including a top plan view of the frame included in the display kit.
Figure 11:
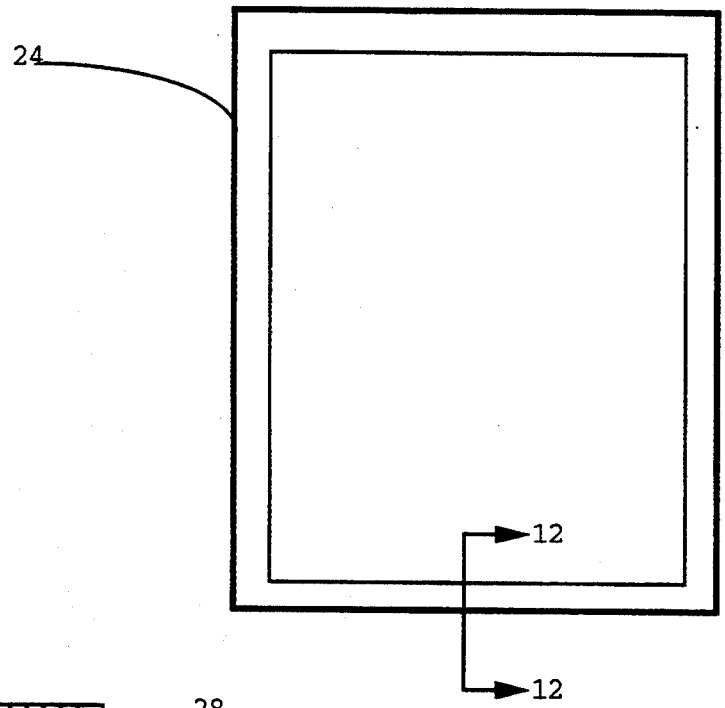

Referring now to FIGS. 6 and 11, the method for carrying imprints of body portions 12 further includes applying a dye substance 32 to at least one portion of the body. This application can be done by dipping the body portion into dye substance 32 or by applying dye substance 32 to body portion via a brush or any suitable means known in the art. Dye substance 32 is made of non-toxic material. Imprints of body portions 12 include human hand 12, bottom portion of human foot 12, and at least one buttock of human rump 12.

The method further includes impressing at least one body portion carrying the dye substance 32 onto sheet member 14, as seen in FIG. 11. The step of impressing further includes disposing dye substance 32 carried by at least one body portion onto sheet member 14 in a position visible in the same direction as picture 20.

Referring now to FIG. 11, the present invention includes a display kit 34 for mounting picture 20 and impressions of body portions 12 which includes any commonly known suitable packaging such as box 36 for holding sheet member 14 having at least one opening 16 and having at least a portion of the surface area 18 of sheet member 14 dye absorbent. Sheet member 14 is composed of a vellum bristol board or any other suitable substance known in the art and opening 16 is oval shaped or any other workable shape known in the art. Surface area 18 is smooth, continuous and absorbent to receive impressions of body portions 12 carrying dye.

Display kit 34 further includes means for mounting picture 20 to sheet member 14 in a position visible through said opening 16 and in a position visible in the same direction as dye absorbent surface 18 and non-toxic dye substance 32. Means for mounting picture 20 to sheet member 14 also include overlying sheet member 14 over another sheet member 22 to secure picture 20 therebetween in which sheet member 14 overlies another sheet member 22 as seen in FIG. 12 (in phantom).

Display kit 34 further includes frame 24 which secures sheet member 14 (in phantom), another sheet member 22 (in phantom), border member 26 (in phantom) and light transmittable panel 28 (in phantom) as seen in FIG. 12. It further includes border member 26 to overlie at least a portion of sheet member 14 as seen in FIG. 9A. If further includes light transmittable panel 28 to overlie sheet member 14 as seen in FIG. 10.

While a detailed description of the preferred embodiments of the invention have been given, it should be appreciated that many variations can be made thereto without departing from the scope of the invention as set forth in the appended claims.

I claim:

1. A method for carrying imprints of body portions, comprising the steps of:

positioning a picture onto a sheet member in which at least a portion of the picture is visible through an opening;

impressing the at least one body portion carrying the dye substance onto the sheet member.

2. The method of claim 1, in which the sheet member is composed of a bristol board.

3. The method of claim 2, in which the sheet member is vellum.

4. The method of claim 1, in which the opening in the sheet member is oval shaped.

5. The method of claim 1, including the step of securing the picture to the sheet member.

6. The method of claim 1, in which the step of positioning includes aligning at least a portion of the picture to be visible through the opening.

7. The method of claim 6, in which the step of securing the picture includes positioning the picture between the sheet member and an another sheet member in which the sheet member overlies the another sheet member.

8. The method of claim 7, in which the step of securing includes securing the sheet member and another sheet member together with a frame.

9. The method of claim 7, in which the another sheet member is made of cardboard.

10. The method of claim 1, including the step of tracing an overlying edge of the border member onto the sheet member.

11. The method of claim 1, including the step of positioning a light transmittable panel to overlie the sheet member.

12. The method of claim 11, in which the light transmittable panel is made of plastic.

13. The method of claim 1, in which the dye substance is non-toxic.

14. The method of claim 1, in which the at least one portion of the body includes a human hand.

15. The method of claim 1, in which the at least one portion of the body includes a bottom portion of a human foot.

16. The method of claim 1, in which the at least one portion of the body includes at least a portion of at least one buttock of the human rump.

17. The method of claim 1, in which the step of impressing includes disposing the dye substance carried by the at least one body portion onto the sheet member in a position visible in the same direction as the picture.

* * * * *